United States Patent [19]

Engdahl et al.

[11] Patent Number: 4,962,780

[45] Date of Patent: Oct. 16, 1990

[54] VARIABLE SUNSHIELD

[75] Inventors: Lawrence W. Engdahl, Guilford; Howard E. Stein, Bridgeport, both of Conn.

[73] Assignee: Stenmisk, Incorporated, Hamden, Conn.

[21] Appl. No.: 306,569

[22] Filed: Feb. 6, 1989

[51] Int. Cl.[5] ..... A01G 13/02

[52] U.S. Cl. ..... 135/20 R; 135/16

[58] Field of Search ..... 135/20, 16, 35 R, 35 S, 135/35 V

[56] References Cited

U.S. PATENT DOCUMENTS

| | | | |
|---|---|---|---|
| 1,039,636 | 9/1912 | Berntlson | 135/35.5 |
| 2,225,699 | 12/1940 | Kastel | 135/16 |
| 2,324,038 | 7/1943 | Steele | 52/306 |
| 2,464,954 | 3/1949 | Werth | 52/306 |
| 3,124,311 | 3/1964 | Kruger | 52/664 |
| 3,249,682 | 5/1966 | Laing | 47/17 |
| 3,478,759 | 11/1969 | Ehrman | 135/20 R |
| 3,557,809 | 1/1971 | Vazquez et al. . | |
| 4,285,577 | 8/1981 | Schuler . | |

FOREIGN PATENT DOCUMENTS

| | | | |
|---|---|---|---|
| 244347 | 11/1960 | Australia | 135/20 R |
| 1418948 | 10/1985 | France | 135/20 R |
| 584016 | 1/1977 | Switzerland | 135/20 R |
| 327749 | 4/1930 | United Kingdom | 135/35 V |

*Primary Examiner*—Henry E. Raduazo

*Attorney, Agent, or Firm*—Bachman & LaPointe

[57] ABSTRACT

A sunshield device is disclosed having two relatively movable, collapsible screen means fabricated of material which upon relative motion between screen means operates to filter, block, scatter and reduce the intensity of solar radiation. The desired effect is achieved by using polarizing film, imprinting patterns of opaque and have parent strips or dots so that upon rotation, translation or orbital motion of one screen means relative to another screen means virtually any desired intensity of solar radiation can be achieved including a complete solar block.

22 Claims, 6 Drawing Sheets

VARIABLE SUNSHIELD

BACKGROUND OF THE INVENTION

The present invention relates to sun shields and relates in particular to such devices that filter, block, scatter or reduce intensity of the sun's radiation thereby protecting the human anatomy, vegetable matter and other animals, instrumentalities or surfaces that are sensitive to solar radiation.

Prior art devices that are pertinent to the present invention are disclosed and described in U.S. Pat. No. 3,557,809, issued Jan. 26, 1971 to Vazquez, entitled Umbrella and U.S. Pat. No. 4,285,577, issued Aug. 25, 1981 to Schuler, entitled Window System Comprising Light Polarizers.

SUMMARY OF THE INVENTION

The present invention provides a sunshield including a plurality of spaced susperposed screen means which are relatively movable to vary the intensity of solar radiation.

For example, the position of one screen means relative to the other can be changed or adjusted through a variety of reproducable settings in order to obtain any desired degree of exposure to solar radiation.

One feature of the invention is to provision of two relatively movable screen means supported on collapsible frames where the screen means are fabricated of flexible polarizing material.

A further feature of the invention is the provision of screen means coated or covered with a protective film to minimize atmospheric wear and tear.

A further feature of the invention is the provision of screen means which are provided with patterned indicia such that when one screen means is moved relative to the other screen means solar radiation is blocked, scattered and reduced in intensity in accordance with wide variations.

A further feature of the invention is the creation of patterned indicia by forming alternate opaque and transparent areas on said screen means by application of tape, ink or silk screening. For example, the indicia may take the form of stripes, checkerboards patterns, or a uniform arrangement of geometric figures, such as, circles, semicircles, triangles and other planar polygons.

A still further feature of the invention is the provision of a manually operable frame device for collapsing one screen means and an automatic means for collapsing another screen means in unison.

A further feature of the invention is the provision of a common shaft for suporting at least two screen means including frame structure where a first screen means and its frame structure are rotatable relative to the shaft and the second screen means and its frame structure is fixed against rotation; both screen means being collapsible about said shaft in the fashion of an umbrella.

A still further feature of the invention is the provision of manually operable eccentric means between the shaft and the first screen means operable in combination with stop means to move the first screen means to vary the relationship between the patterned indicia of the screen means in accordance with a variety of combinations and permutations.

A further feature of the invention is the provision of radial cut-outs in the central region of at least one screen means to facilitate collapsing and to reduce bulk.

A further feature of the invention involves the generation of relative motion between vertically spaced screen means by (a) rotating one screen means relative to the other (b) moving the center of one screen means relative to the center of the other along a rectilinear path or in the alternative, orbiting the central axis of one screen means about the central axis of the other while the screen means remain stationary relative to their respective central axes.

A further feature of the invention is the provision of a restraining means connecting two spaced screen means to preclude relative rotation when the respective axes of the screen means are in the translating or orbiting mode.

A further feature of the present invention is the provision of a novel process for controlling solar radiation.

A still further feature of the invention is the provision of suitable indicator means to facilitate setting, resetting or repeating a desired relative position between cooperating screen means.

A still further feature of the invention is the provision of thin, transparent, flexible film incorporating ultraviolet blockers as an overlay upon said polarizing film to enhance the polarizing effect of the polarizing film and to compensate for wear and tear.

Other features and advantages of the present invention will become more apparent from an examination of the succeeding specification when read in conjunction with the appended drawings, in which:

DETAILED DESCRIPTION OF THE PREFERRED EMBODIMENTS

Figure 1:
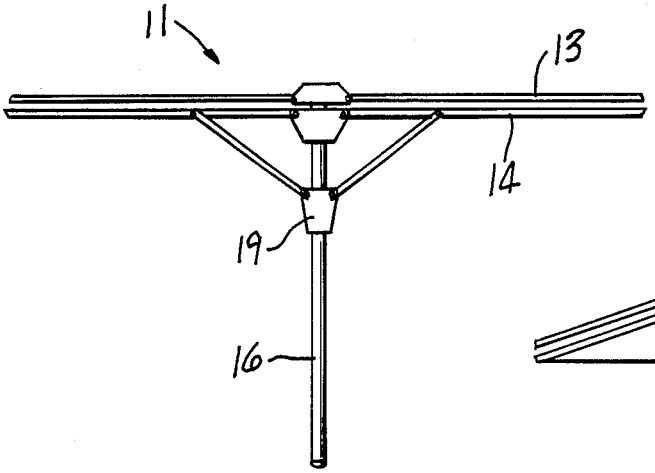
FIG. 1 is a side elevation of an erect, flat sunshield device showing two spaced screen means having a common axis where the first screen means (top) is rotatable about a shaft means and the second screen means (bottom) is fixed against rotation, both screen means being collapsible.
Figure 2:
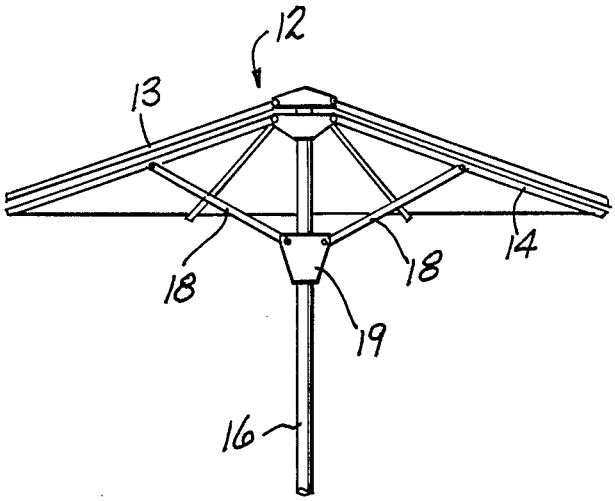
FIG. 2 is a view similar to the showing of FIG. 1 except that the erect position is like that of an umbrella.

Referring to FIGS. 1–4, the reference numerals 11 and 12 indicate, generally, umbrella-like sunshield devices having flat and inclined top surfaces, respectively.

Each device includes a first screen means 13 and a second screen means 14 which, in this embodiment of the invention, define screens fabricated of flexible polarizing film.

Figure 3:
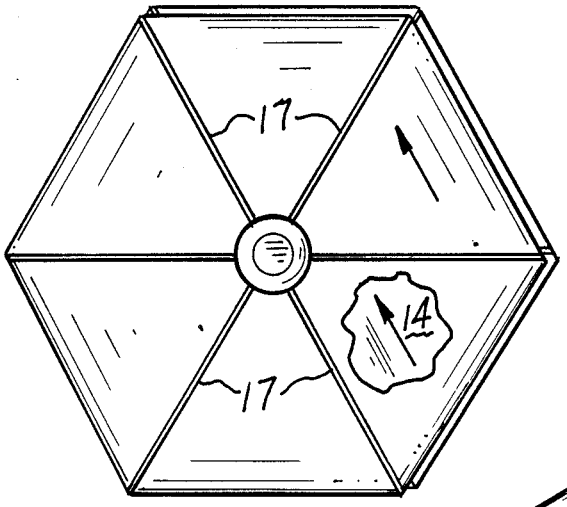
FIGS. 3 and 4 shows screen means fabricated of polarizing material in the full sunlight transmission position and the full sunlight blocked position, respectively.
Figure 4:
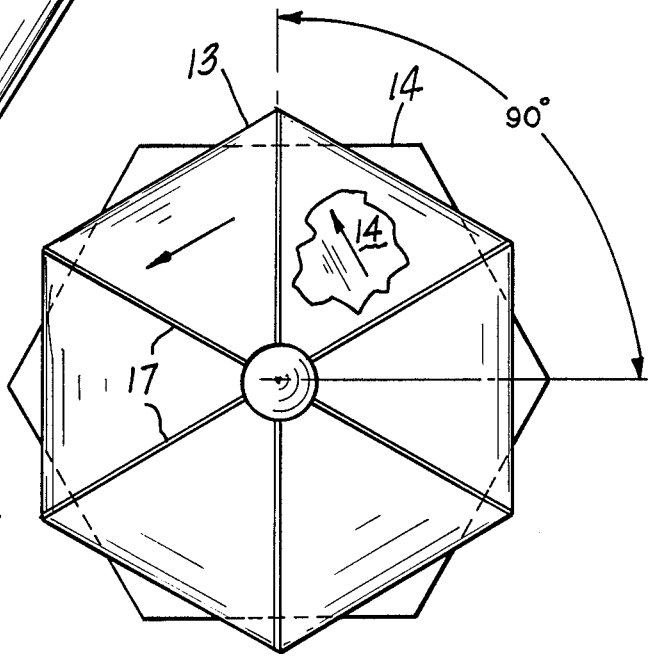

The screens are spaced apart vertically and the top screen means 13 is rotatable about shaft 16 and the bottom screen means is fixed against rotation so that upon relative motion between the two screen means, as indicated in FIGS. 3 and 4, a polarization of solar radiation is effected ranging from maximum sunlight transmission to a complete blockage.

Each screen is supported by a frame structure defining radially extending ribs 17—17 and stays 18—18 and the second screen means is collapsible by sliding stay support 19 axially along shaft 16 in the fashion that one collapses an umbrella. A spring catch (not shown) latches the stay support 19 to the shaft 16 in a well known way.

In a manner which will become more apparent as this specification proceeds, the first screen means 13 collapses automatically and follows the manually actuated collapse of the second screen means 14.

The arrows of FIG. 3 shows the respective screen means with the polarization of both screens in the same attitude to permit maximum sunlight while in FIG. 4 the arrows indicate that the top screen means 13 has rotated 90° relative to the second screen means such that the respective lines of polarization block out sunlight completely. Incremental degrees of rotation between 0° and 90° permits one to adjust the intensity of solar radiation as desired.

The rotation of the first screen means 13, of this embodiment of the invention, is conducted by merely grasping the convenient rib 17 of the top screen means and moving the screen relative to the bottom screen to the desired location.

The invention contemplates the inclusion of appropriate indicia or markings on one or both of the screen means to serve as a gauge or indicator for indicating various relative rotational positions of the two screen means.

Such an arrangement of indicia operates in the fashion of matching pointers or matching labelled marks on the respective screen means thereby facilitating resetting or repeating a desired rotational relative position between the screen means and providing a recordable indication of a desired solar radiation intensity.

Figure 5:
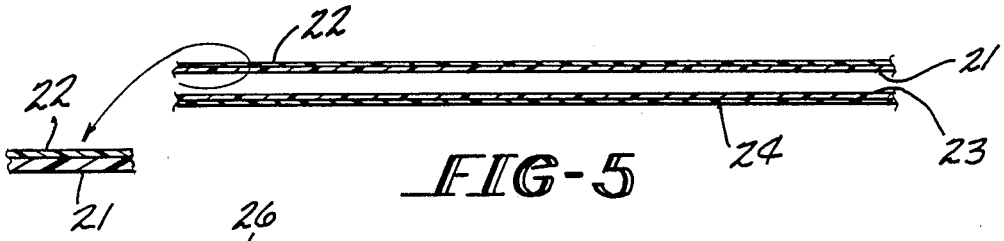
FIGS. 5–7 are vertical cross-sectional views of portions of typical screen means showing construction and patterns.
Figure 6:
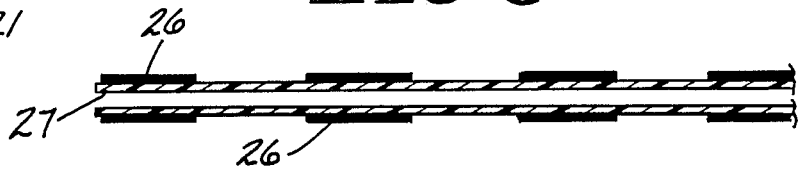
Figure 7:
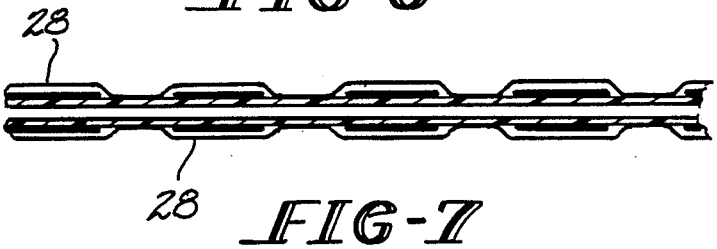

Referring to FIGS. 5, 6 and 7, vertical sections of portions of screen means are disclosed indicating various materials and patterns for accomplishing modification in solar radiation.

In FIG. 5, polarizing film 21 is covered with a protective flexible plastic film 22 and polarizing film 23 is similarly protected by a flexible plastic film 24.

FIG. 6 shows an alternative arrangement of screen design wherein opaque ribbons 26 are laid down upon a transparent film 27 resulting in a screen structure having alternate ribbons of transparency and opacity. These ribbons may take the form of ink imprints, tape or may be applied by the well-known silk screening procedure. Any scheme for laying down opaque ribbons is within the spirit and scope of the invention.

FIG. 7 shows an arrangement similar to FIG. 6 plus the application of a protective film 28 which is useful to overcome the wear and tear due to weather and extensive use.

Figure 8:
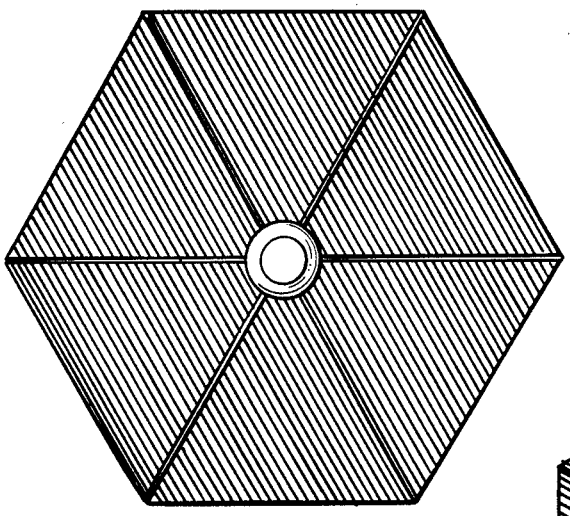
FIGS. 8 and 9 show, schematically, typical alternating opaque and transparent stripes in the light transmission and light blocking positions, respectively.
Figure 9:
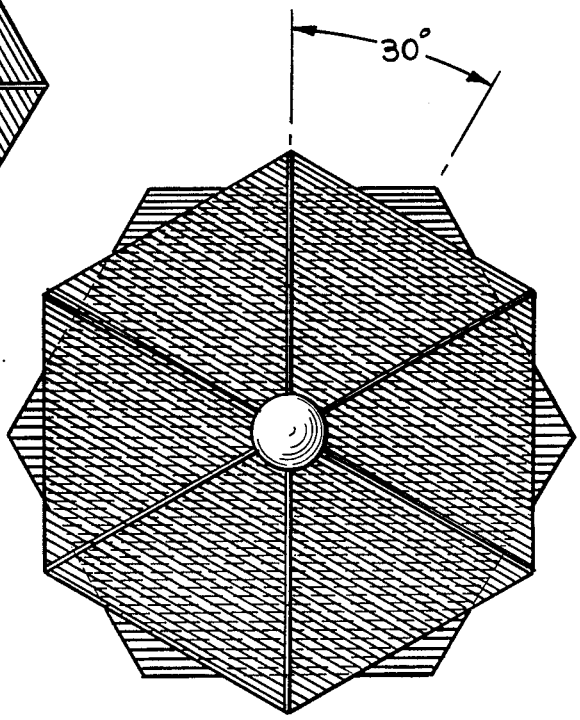

Referring to FIGS. 8 and 9, there is a schematic representation of the effect and operation of screens fabricated in accordance with the illustrations of FIGS. 6 and 7. For example, FIG. 8 shows the screens positioned (aligned) so that the opaque stripes of each screen overlay one another with the intervening clear strips in similar alignment. Whereas FIG. 9 shows the screens having been rotated relatively through 30° whereby portions of the clear stripes are blocked by the opaque ribbons to reduce the intensity of solar radiation.

Figure 10:
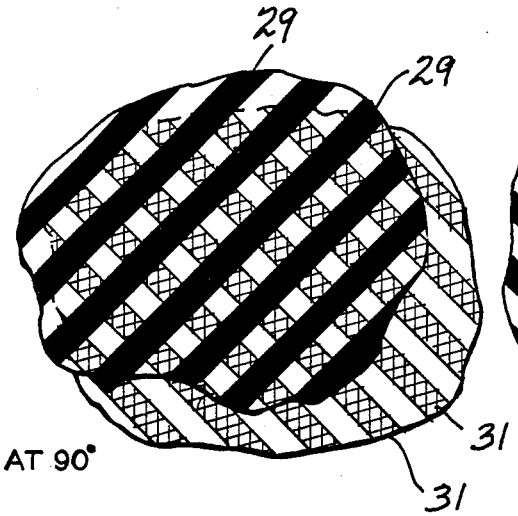
FIGS. 10 and 11 show segments of two striped screen means (enlarged) illustrating variations in stripe patterns and the effect at two different relative positions.
Figure 11:
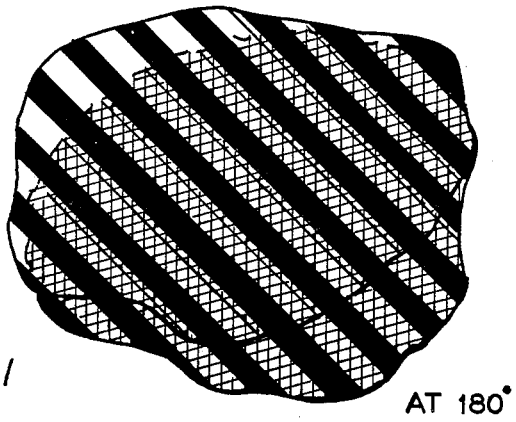

FIGS. 10 and 11 show portions of various alternative patterned indicia for achieving various degrees of solar radiation control. For example, in FIG. 10, the dark ribbons 29 of the first screen means (top screen) are completely opaque blocking approximately 50% of transmitted light while the dark ribbons 31 of the second screen means are partially opaque (or of any desired degree of opacity) so that upon 90° relative rotation one can develop the pattern and thus the solar intensity situation corresponding to FIG. 10 while further relative rotation through 180° develops a screen pattern and correspondingly reduced ratiation indicated schematically in FIG. 11.

It is to be understood that the patterned indicia is not limited to transparent strips or to stripes with different degrees of opacity. It is entirely within the spirit and scope of the invention to provide any suitable pattern and degree of opacity and transparency in the fashion of a checkerboard pattern or any other period or uniform arrangement of opaque and transparent areas throughout the first and second screen means. Colored patterns are also within the scope of the invention.

In addition, as will become more apparent as this specification preceeds, it is anticipated that the relative motion generated between the respective screen means can be rotary, rectilinear or orbital in nature.

The term "rectilinear" is intended to mean moving centers of the respective sreen means along a straight line path. The term "orbital" is intended to position centers of screens a distance e and thereafter rotating one center relative to the other center at radius e.

It is important to maintain alignment between the first and second screen means and their respective frame means so that upon relative motion the desired effect is achieved and can be reestablished repeatedly.

Figure 12:
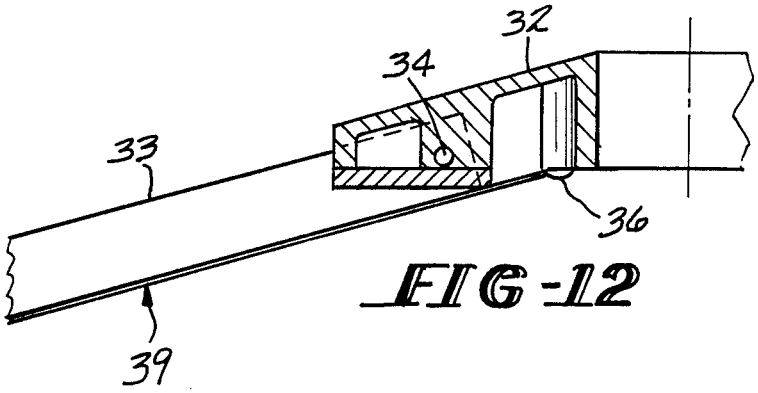
FIGS. 12 and 13 show a portion of a hub and the central portion of a screen means detailing structure for aligning a screen means to the hub accurately.
Figure 13:
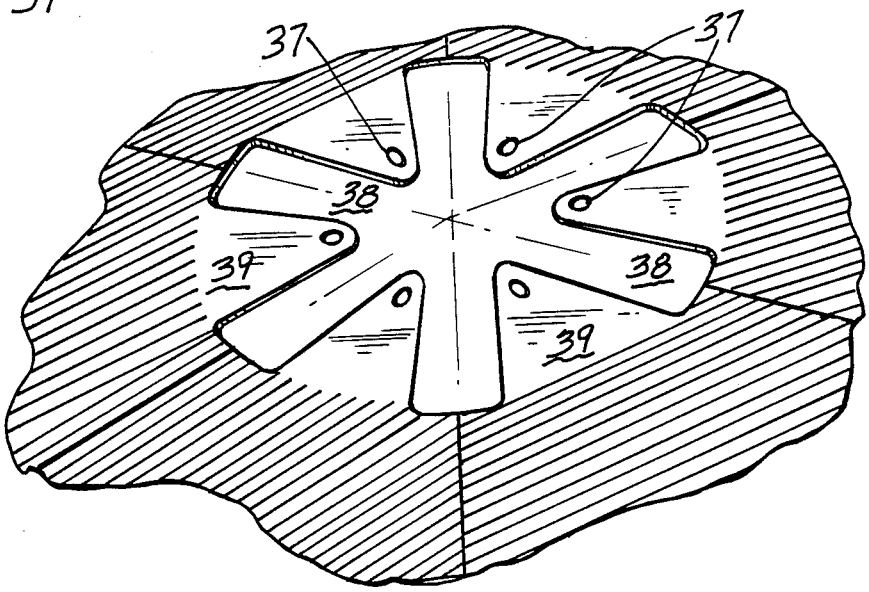

In FIGS. 12 and 13, a structure keying a screen means to its hub and frame structure is shown. Specifically, a segment of the screen frame means hub is disclosed showing its cooperation with the center area of a screen means.

The hub 32 making a hinge connection with a rib 33 is free to flex about hinge pin 34 upon collapse of the screen means in umbrella fashion. Aligning pins 36 (only one shown) engage cooperating openings 37 in the center portion of the screen means of FIG. 13 so that an array of pins 36 are received in openings 37 to insure the position of the screen relative to its hub and rib structure.

Cut-outs 38 are formed in the central region of the screen means alternating with screen tabs 39 to facilitate collapsing the screen means and to reduce collapsed bulk.

Figure 14:
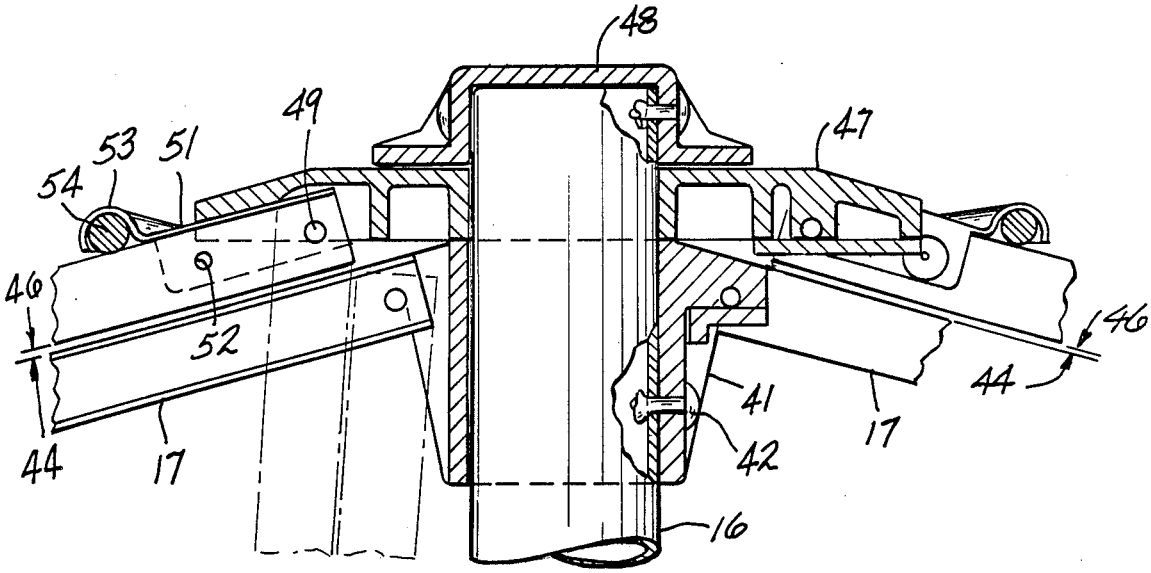
FIG. 14 is a vertical sectional view of a typical hub structure.

FIG. 14 is a vertical section of the hub structure of a set of screen means which create relative rotational motion.

Shaft 16 supports a hub 41 fixed to the shaft by a rivet 42. Radially extending ribs lower 17—17 are hinged to the hub 41 by hinge pins 43.

A screen means 44, supported by the rib structure, is stretched taut and secured by suitable means.

Top screen means 46 having hub 47 is rotatable about shaft 16 and is retained in position by shaft cap 48.

The ribs 17 of screen means 46 hinged to the hub 47 by hinge pins 49 include a bracket 51 secured to the upper rib 17 by a rivet 52. The bracket 51 includes a keeper 53 for retaining an elastic ring 47 which encircles the screen means 46 in the region of its hub 47 under tension.

Thus, when the second or lower screen means 44 is collapsed manually in the fashion of the collapse of an umbrella, the tension in the elastic ring 54 causes the first screen means (top screen means) to collapse automatically following the collapse of the lower screen means.

Figure 15:
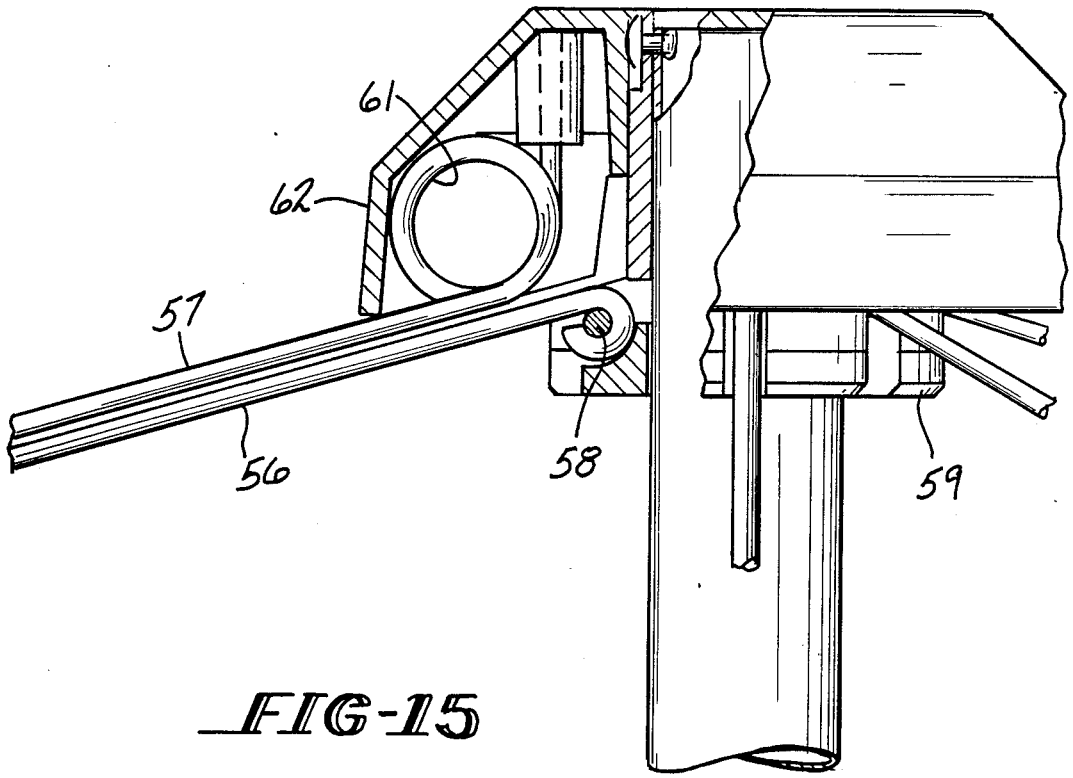
FIG. 15 is a partial vertical sectional view showing a spring means for collapsing the top screen means automatically.

FIG. 15 shows an alternative rib structure and a modified means for powering automatic collapse of the top screen means.

First, the ribs 56 and 57 are fabricated of wire in contrast to an extrusion or other cross-section. Rib 56 is pivoted at hinge pin 58 in turn connected to its hub 59.

Rib 57 terminates in a coil spring 61 within hub housing 62 and is biased toward a collapsing mode so that when the lower screen means is collapsed manually, the upper screen means follows automatically in response to the bias of coil spring 61.

Figure 16:
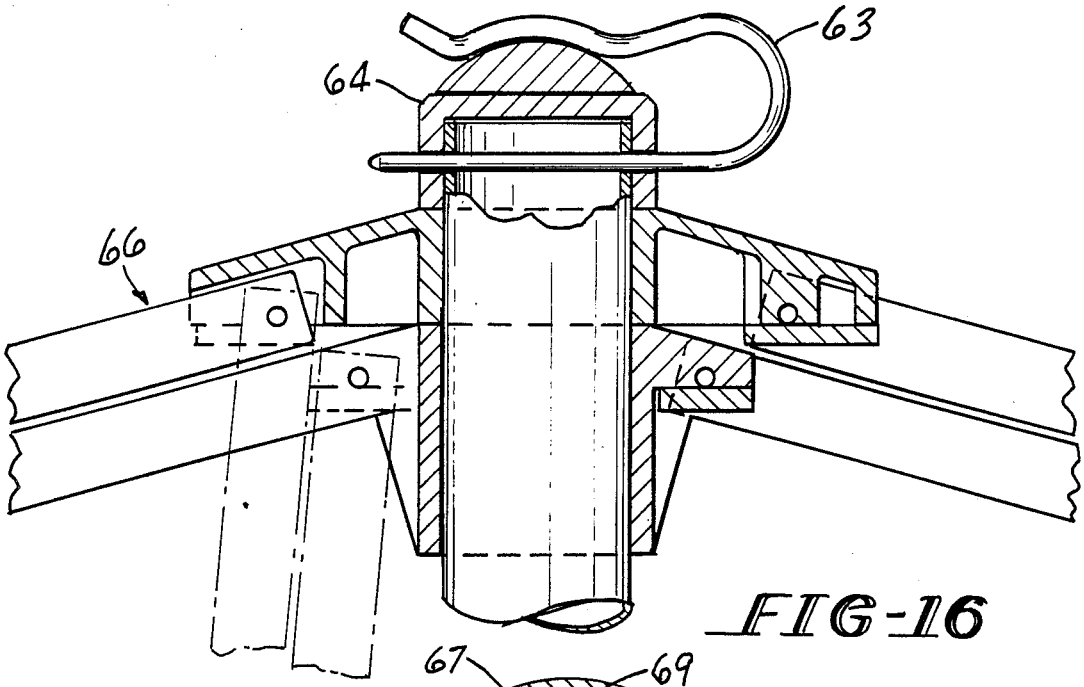
FIG. 16 is a further sectional view of the hub structure illustrating a quick operating clip for releasing the top screen means.
Figure 18:
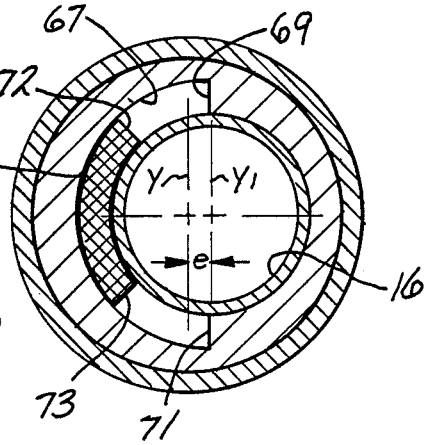
FIG. 18 is a horizontal cross-section in the plane of the line 18—18 of FIG. 17.
Figure 17:
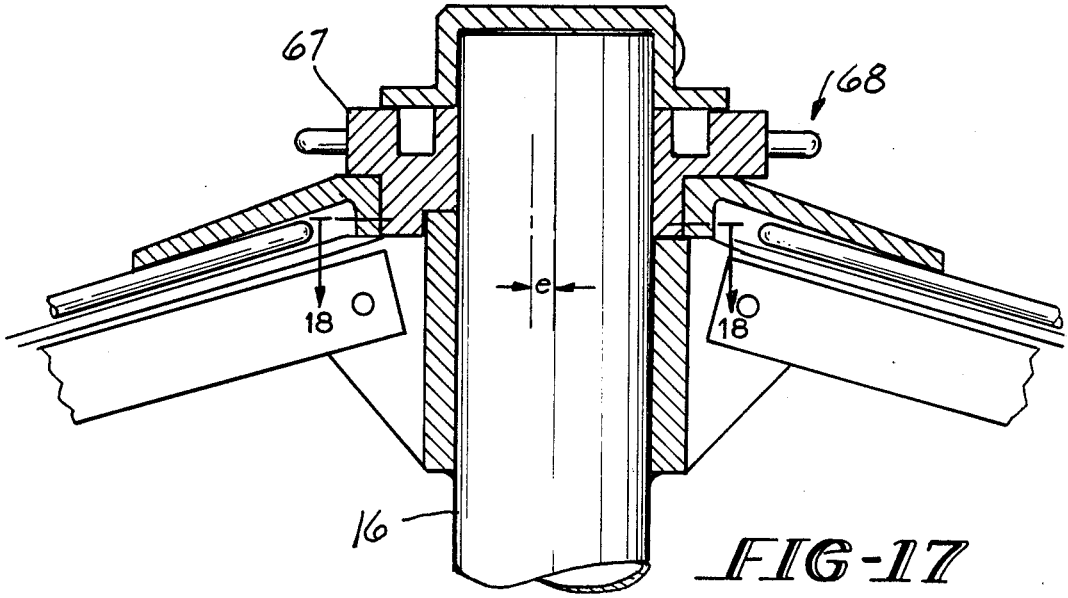
FIG. 17 is a vertical section of the hub structure including an eccentric ring for shifting the top screen means relative to the bottom screen means.
Figure 20:
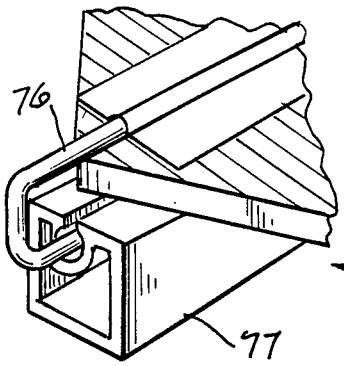
FIG. 20 is an enlarged view of a portion of FIG. 20 illustrating a restraint mechanism for permitting rectilinear motion but precluding rotary motion between the screen means.
Figure 19:
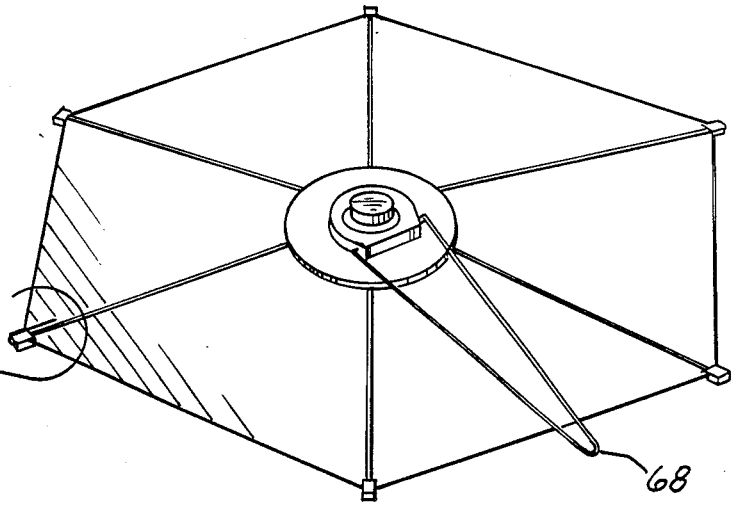
FIG. 19 is a perspective view of the top side of the sunshield showing a lever for manipulating the eccentric ring of FIG. 17 to produce rectilinear relative motion, i.e. screen means centers move in a straight line.

FIG. 16 shows a quick operating snap spring 63 for quick release of shaft cap 64 freeing top screen means 66 for removal.

FIGS. 17, 18, 19 and 20 show details of the structure for providing relative motion between the top and bottom screen means by translating (moving) the center of one screen means relative to the center of the other along a rectilinear or straight line path to effect a change in the solar radiation projected through the first and second screen means.

The lower screen means remains fixed to the shaft 16 while the center line y of the upper screen means is cast (offset) from the shaft center line y-1 a distance equal to dimension e by an accentric ring 67.

The ring 67, rotated by lever 68 (FIG. 19) moves ring 67 to and fro about shaft 16 within limits created by the abutment of ring shoulders 69 and 71 with the shoulders 72 and 73, respectively, of stop 74 fixed to shaft 16.

To insure that the relative motion between the screen means is rectilinear and not rotational at least one set of ribs 76 and 77 (FIG. 20) are connected movably to permit linear motion while blocking rotary motion. Note that in FIG. 20, rib 76 (top screen means) has a return bend portion which engages a mating recess in rib 77 (lower screen means) to permit linear motion to effect screen translation and to allow screen collapse.

Figure 22:
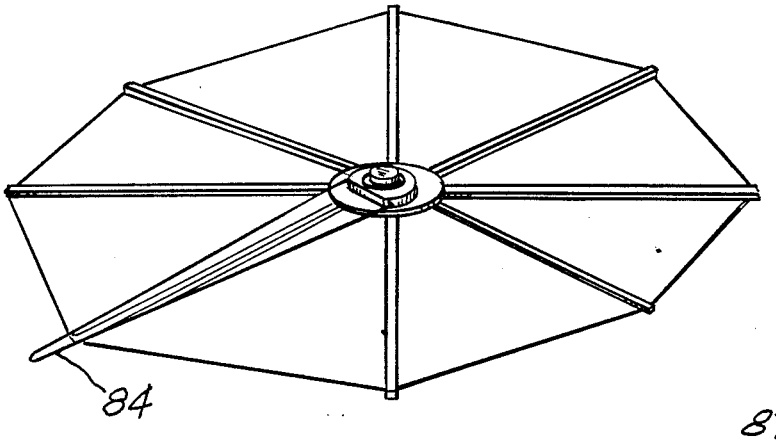
FIG. 22 is a view similar to FIG. 19 showing a lever for manipulating the eccentric ring of FIG. 21 to produce orbital relative motion between the screen means, i.e. the center of one screen means rotates about the center of the other at a fixed radius.
Figure 23:
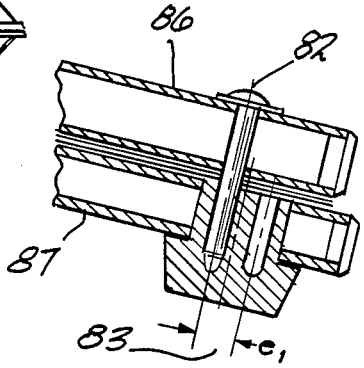
FIG. 23 is an enlarged view of a portion of FIG. 22 illustrating an orbital restraint mechanism having a radius identical to the fixed radius of FIG. 22.
Figure 21:
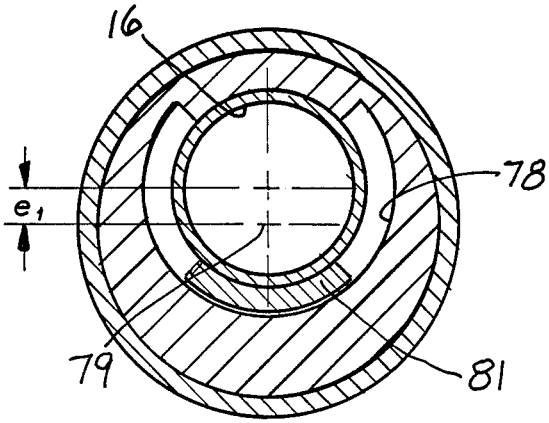
FIG. 21 is a view similar to FIG. 18 showing a modified eccentric ring arrangement.

FIGS. 21, 22 and 23 show modified eccentric structure for effecting orbital relative motion.

In this arrangement, the eccentric 78 disposed in the position shown in FIG. 21 offsets the center 79 of the top screen means from the center of the shaft 16 by a dimension e-1 so that operation (rotation) of the eccentric to and fro about fixed stop 81 causes the center of the top screen means to orbit about the center of the shaft at radius e-1.

This type of relative motion between the respective screen means in combination with an appropriate pattern of indicia formed on the respective screen means operates to provide an alternative system for creating a wide variety of intensity levels for solar radiation playing upon the upper screen means.

In order to stabilize the orbital relative motion, one or more of the terminal ends of the ribs 86 and 87 are connected by an eccentric arrangement having axes 82 and 83 which operate in unison with the operation of eccentric 78 actuated by lever 84. This arrangement precludes relative rotation and insures orbital motion when the lever 84 is operated manually through the arcs generated as the center of the upper screen means moves about stop 81 in a clockwise or a counterclockwise direction.

It is apparent that there has been provided in accordance with this invention a variable sunshield which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A sun shield device comprising:

a shaft means, a first screen means extending about said shaft means, a second screen means extending about said shaft means overlapping said first screen means, each screen means having a plurality of areas of different opacity, each area being operable to transmit a different degree of solar radiation, at least one screen means being rotatable about said shaft means relative to the other screen means whereby the relative position of the first and second screen means varies the transmission of solar radiation through said sun shield device.

2. The device of claim 1 in which the screen means are fabricated of flexible polarizing material.

3. The device of claim 1 in which the screen means are covered with a protective coating or film.

4. The device of claim 1 in which the screen means are substantially coextensive and the first screen means is spaced vertically from said second screen means.

5. The device of claim 1 wherein the areas of different opacity define a pattern.

6. The device of claim 5 in which the pattern is printed. .

7. The device of claim 5 in which the pattern is silk screened.

8. The device of claim 1 wherein at least one screen means includes at least one area of transparency.

9. The device of claim 1 in which the opaque areas define tape segments secured adhesively to said screen means.

10. The device of claim 1 in which at least one screen means is formed with a plurality of radially extending cut-outs to facilitate collapsing said screen means thereby reducing bulk.

11. A sunshield device comprising:

a first screen means, a second screen means, means for moving said first and second screens relative to one another effective to block undesirable components radiating from the sun, each screen means being supported by a frame means, said frame means being connected to a common shaft means and being spaced axially along said shaft means, each frame means including means for collapsing said screen means in unison about said shaft means whereby one screen means overlays the other screen means in the collapsed condition, the means for collapsing said first screen means being automatic, said automatic collapsing means defining spring means incorporated in the frame means of said first screen means, said spring means being biased so as to tend to collapse said first screen means and its frame means.

12. A sunshield device comprising:

a first screen means, a second screen means, means for moving said first and second screen means relative to one another effective to block undesirable components radiating from the sun, each screen means being supported by a frame means, said frame means being connected to a common shaft means and being spaced axially along said shaft means, said shaft means having a longitudinal central axis;

said second screen means being slidable axially along said shaft means, said first screen means being rotatable about the central axis of said shaft means, movable eccentric means disposed between the shaft means and said first screen means, and lever means connected to said eccentric means operable to move said eccentric means relative to said shaft means to displace said first screen means relative to said second screen means, whereby both said screen means are concentric initially and operation of said lever means moves the center of one screen means along rectilinear path relative to the center of the other screen means.

13. The device of claim 12 including restraint means connecting both said screen means operable to permit said motion along said rectilinear path while blocking relative rotary motion.

14. A sunshield device comprising:

a first screen means, a second screen means, means for moving said first and second screens relative to one another effective to block undesirable components radiating from the sun, each screen means being supported by a frame means, said frame means being connected to a common shaft means and being spaced axially along said shaft means, said shaft means having a longitudinal central axis, said second screen means being slidable axially along said shaft means and said first screen means being rotatable about the central axis of said shaft means, movable eccentric means disposed between the shaft means and said first screen means, lever means connected to said eccentric means operable to move said eccentric means relative to said shaft means to displace said first screen means relative to said second screen means, whereby the centers of the screen means are offset by a radius e initially and operation of the lever means moves the center of one screen means arcuately about the center of the other screen means at radius e.

15. The device of claim 14 including restraint means connecting both said screen means operable to permit said arcuate motion between said centers.

16. A sunshield device comprising:

a first screen means, a second screen means, means for moving said first and second screens relative to one another effective to block undesirable components radiating from the sun, each screen means being supported by a frame means, said frame means being connected to a common shaft means and being spaced axially along said shaft means, said shaft means having a longitudinal central axis, said second screen means being slidable axially along said shaft means and said first screen means being rotatable about the central axis of said shaft means, movable eccentric means disposed between the shaft means and said first screen means, lever means connected to said eccentric means operable to move said eccentric means relative to said shaft means to displace said first screen means relative to said second screen means, stop means fixed to the shaft means for limiting the motion of the eccentric means.

17. A sunshield device comprising:

a first screen means, a second screen means, means for moving said first and second screen means relative to one another effective to block undesirable components radiating from the sun, each screen means being supported by a frame means, said shaft means having a longitudinal central axis, said second screen means being slidable axially along said shaft means and said first screen means being rotatable about the central axis of said shaft means, eccentric means disposed between the shaft means and said first screen means, lever means connected to said eccentric means operable to move said eccentric means relative to said shaft means to displace said first screen means relative to said second screen means, said eccentric means being ring-shaped.

18. A method of shielding an individual from deleterious effects of solar radiation comprising the steps of:

providing at least two generally circular, flexible screens each having at least two contiguous sections, each section of each screen having a different degree of permeability relative to solar radiation, attaching said screens rotatably to a shaft, and rotating one screen relative to the other to regulate the degree of solar radiation transmitted through both screens whereby exposure of the skin of said individual to solar radiation is controlled.

19. The method of claim 18 wherein the screens are fabricated of polarizing film.

20. The method of claim 18 plus the step of creating spaced opaque areas on the screens to form a uniform pattern of opacity and transparency.

21. The method of claim 20 plus the step of creating opacity on one screen of greater intensity than the opacity of the other screen.

22. A method of shielding an animal, a plant or a surface from deleterious effects of solar radiation comprising the steps of:

providing at least two generally circular, flexible screens each having at least two contiguous sections, each section of each screen having a different degree of permeability relative to solar radiation, attaching said screens rotatably to a shaft, and rotating one screen relative to the other to regulate the degree of solar radiation transmitted through both screens whereby exposure of said animal, plant or surface to solar radiation is controlled.

* * * * *